United States Patent [19]

Utter

[11] Patent Number: 4,552,518

[45] Date of Patent: Nov. 12, 1985

[54] SCROLL MACHINE WITH DISCHARGE PASSAGE THROUGH ORBITING SCROLL PLATE AND ASSOCIATED LUBRICATION SYSTEM

[75] Inventor: Robert E. Utter, Genoa, Wis.

[73] Assignee: American Standard Inc., New York, N.Y.

[21] Appl. No.: 581,848

[22] Filed: Feb. 21, 1984

[51] Int. Cl.[4] ..... F04C 18/04; F04C 29/02

[52] U.S. Cl. ..... 418/55; 418/97; 418/188; 418/DIG. 1; 417/369

[58] Field of Search ..... 418/55, 188, 97, 96, 418/99, DIG. 1; 417/902, 369

[56] References Cited

U.S. PATENT DOCUMENTS

| | | | |
|---|---|---|---|
| 1,376,291 | 4/1921 | Rolkerr | 418/55 X |
| 4,314,796 | 2/1982 | Terauchi | 418/55 X |
| 4,365,941 | 12/1982 | Tojo et al. | 417/372 |
| 4,389,171 | 6/1983 | Eber et al. | 418/15 |
| 4,457,676 | 7/1984 | Hiraga | 418/55 |
| 4,487,560 | 12/1984 | Uchikawa et al. | 418/55 |

FOREIGN PATENT DOCUMENTS

| | | | |
|---|---|---|---|
| 57-08386 | 1/1982 | Japan | 418/55 |
| 57-18491 | 1/1982 | Japan | 418/188 |
| 57-70984 | 5/1982 | Japan | 418/4 |

*Primary Examiner*—John J. Vrablik
*Assistant Examiner*—Theodore Olds
*Attorney, Agent, or Firm*—Ronald M. Anderson; Carl M. Lewis; William J. Beres

[57] ABSTRACT

A scroll compressor enclosed in a hermetic shell, wherein part of the volume enclosed by the shell is at suction pressure and part is at discharge pressure. The compressor includes both a stationary and a driven scroll plate, with intermeshed involute wrap elements attached to the plates for defining pockets in which fluid is compressed as a drive shaft connected to the driven plate causes it to orbit relative to the stationary scroll plate. A passage disposed within the driven plate and adjacent its axial center conveys compressed fluid through the plate and into a cavity formed in the end of the drive shaft. Oil entrained in the compressed fluid is thrown radially outward within the cavity, due to centrifugal force, and is thereby separated from the compressed fluid. The oil then flows through an adjacent bearing, and is thrown radially outward, creating a spray that impinges on a seal which abuts the back surface of the driven scroll plate. A drive shaft bearing also receives lubrication as the oil flows back into the reservoir at the bottom of the shell.

11 Claims, 3 Drawing Figures

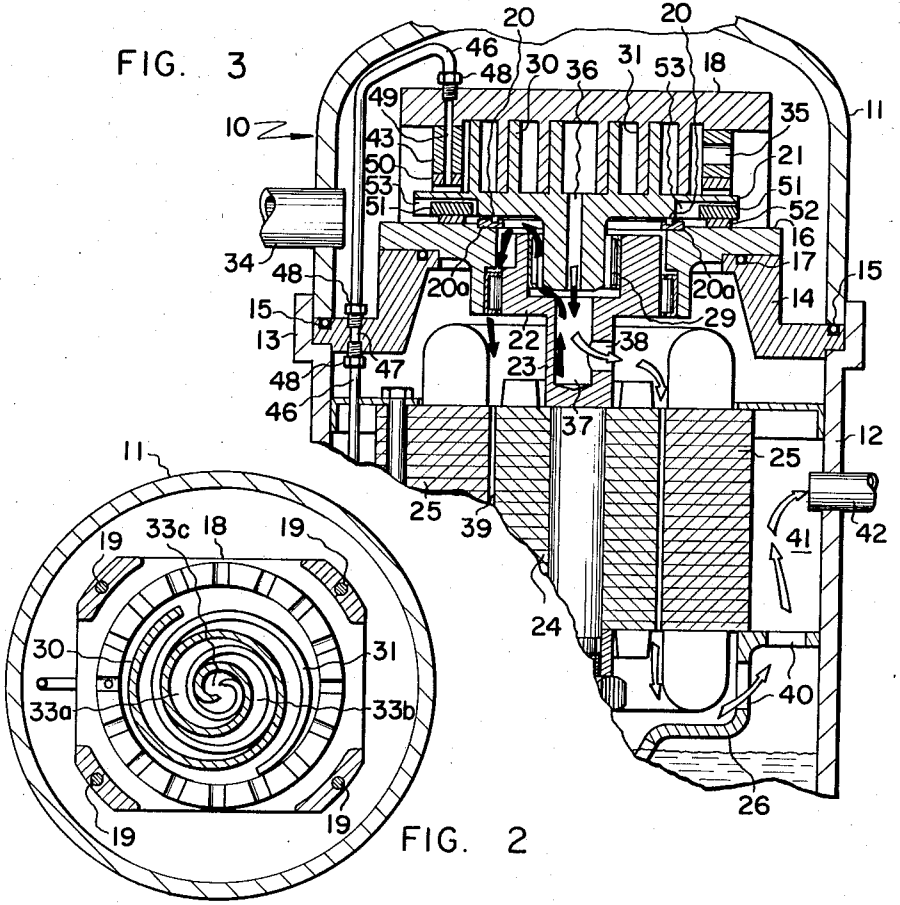
FIG. 3
FIG. 2
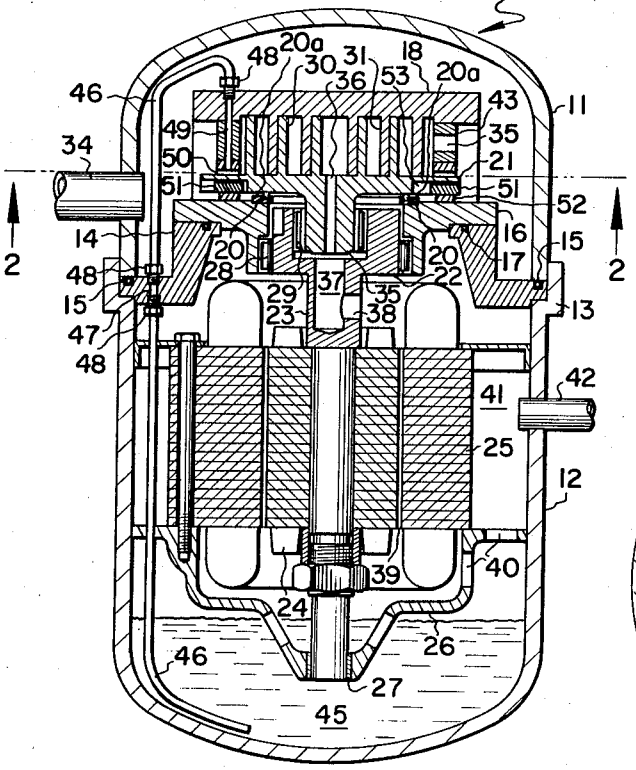
FIG. 1

SCROLL MACHINE WITH DISCHARGE PASSAGE THROUGH ORBITING SCROLL PLATE AND ASSOCIATED LUBRICATION SYSTEM

DESCRIPTION

TECHNICAL FIELD

This invention generally pertains to a scroll compressor and associated lubrication system, and specifically to a scroll compressor having a discharge passage through the driven scroll plate, with means for separating oil from a compressed fluid and delivering the oil to adjacent bearings.

BACKGROUND ART

The conventional design for a scroll compressor usually includes a stationary scroll plate and a driven scroll plate disposed in parallel, facing arrangement, each plate having involute wrap elements attached in intermeshed, fixed angular relationship. The driven plate is caused to move in an orbital path relative to the stationary plate so that pockets of fluid defined by flank surfaces of the wrap elements move between an inlet adjacent the radially outer ends of the wrap elements and an outlet adjacent the axial center of the wrap elements.

The conventional scroll compressor has an outlet opening in the stationary scroll plate through which compressed fluid is discharged, either into an enclosed volume, or directly into a tube leading to an external discharge port. If the scroll compressor is housed within a hermetic shell, the volume enclosed by the shell may be at suction pressure, discharge pressure, or split into two parts, one at suction and the other at discharge pressure. Examples of each configuration are shown in U.S. Pat. Nos. 4,389,171 and 4,365,941, and Japanese Laid Open Patent Application No. 57-70984, respectively. Where the shell is at discharge pressure, suction fluid is delivered to the involute inlet either directly as shown in the '941 patent or via a tube that extends from the scroll plates to a suction port in the shell. If the shell is divided into two parts at different pressures, as disclosed in the above-cited Japanese Laid Open Application, compressed fluid is conveyed via a passage through the stationary scroll plate to the lower part of the shell enclosing the compressor drive shaft; the inlet to the radially outer ends of the involutes is in fluid communication with the upper part of the shell, i.e., with the volume that is at suction pressure.

The manufacturing costs of providing a radial discharge passage within the stationary scroll plate is prohibitive. A lower cost alternative would be to provide a discharge tube extending from a port in the center of the stationary plate over to the periphery of the scroll plates, and through the framework of the compressor to the volume comprising the lower part of the shell. The disadvantage of this approach is that the discharge tube would pass through the volume of fluid which is at suction pressure, resulting in undesirable heat transfer between the hot compressed fluid and the cooler suction gas.

The configuration selected for the scroll compressor can greatly affect the design of its lubrication system. For a scroll compressor enclosed in a shell at suction pressure, oil is usually pumped from a reservoir at the bottom of the shell through a bore in the drive shaft to bearings and other surfaces requiring lubrication. Centrifugal force developed by rotation of the drive shaft carries the oil up the bore to various lateral passages that direct lubricant to the bearings.

In a "high side compressor", the oil reservoir is exposed to discharge pressure. This pressure may be used to force oil through a small diameter delivery tube up to the involute inlet. At this point, the oil mixes with the fluid being compressed and is carried through the compression cycle. The oil improves the seal along the flanks and the tip surfaces of the involute wrap elements and reduces friction. However, oil must be separated from the compressed fluid before it is discharged from the compressor shell. Once separated, the oil should be used to lubricate other parts of the compressor before being allowed to flow back into the reservoir.

In consideration of the foregoing, it is an object of this invention to provide a split shell scroll compressor with both high efficiency and relatively low production costs.

It is a further object to minimize heat transfer between compressed fluid discharged from the scroll plates and suction fluid entering the compression cycle.

A still further object is to discharge compressed fluid directly through the orbiting scroll plate.

Yet a further object is to supply oil to the involutes to improve their sealing action and to reduce friction.

Moreover, it is an object of this invention to separate entrained oil from the compressed fluid as it is discharged from the scroll plates, and to cause the oil to lubricate adjacent bearing surfaces.

These and other objects of the invention will be apparent by reference to the attached drawings and to the description of the preferred embodiment that follows hereinbelow.

SUMMARY OF THE INVENTION

The subject invention is a scroll machine for compressing a fluid. It includes two scroll plates with intermeshed involute wrap elements defining pockets in which the fluid is compressed as the plates orbit relative to each other. One of the plates is driven in an orbital path by driving means that include a drive shaft rotatably connected to the driven plate at a point that is eccentrically disposed relative to the longitudinal axis of the drive shaft. The driving means are sealingly enclosed in a shell. A passage through the driven scroll plate, disposed adjacent the axial center of its involute wrap element, is in fluid communication with the volume enclosed by the shell. Fluid compressed by the orbital motion of the plates is discharged into the enclosed volume through this passage.

Also included are an oil reservoir disposed within the shell and means for delivering oil from the reservoir to the radially outer ends of the involute wrap elements. The oil is carried with the fluid as it is compressed by the motion of the plates and their attached wrap elements, and is discharged with the compressed fluid via the passage through the driven scroll plate. A substantial part of the oil is separated from the compressed fluid and is delivered to one or more adjacent bearing surfaces.

BRIEF DESCRIPTION OF THE DRAWINGS

FIG. 1 shows a cutaway view of a scroll compressor in elevational aspect, configured according to the present invention.

FIG. 2 is a cross-sectional view of the scroll compressor of FIG. 1, taken along section line 2—2.

FIG. 3 is an exploded view of the upper portion of the scroll compressor, showing the path followed by the lubricant after it exits the orbiting scroll plate.

DISCLOSURE OF THE PREFERRED EMBODIMENT

As shown in FIG. 1, reference numeral 10 generally denotes a scroll compressor incorporating the subject invention. Scroll compressor 10 includes an upper hermetic shell 11 sealingly joined to a lower hermetic shell 12 by means of a flange 13. The upper shell 11 is seated in and welded to flange 13, and acts as a retainer to hold a supporting frame member 14 in place. An "O"-ring seal 15 abuts the lower edge of upper shell 11 in sealing contact. Likewise, supporting frame 14 is connected to a supporting frame member 16, and their junction is sealed by O-ring seal 17.

Supporting frame 14 and frame member 16 are operative to support a stationary scroll plate 18 within the volume enclosed by upper shell 11. FIG. 2 shows four bolts 19 (in cross section) that are used to connect the stationary scroll plate 18 to supporting frame member 16. A thrust seal 20 is supported by a seal ring **20*a* on frame member 16 in abutting relationship to the lower surface of an orbiting scroll plate 21. Thrust seal 20, supporting frame 14 and frame member 16, in conjunction with orbiting scroll plate 21, thus divide the volume enclosed by the hermetic shell 11 and 12 into an upper and a lower portion. The lower surface of the orbiting scroll plate 21 which is radially external to thrust seal 20 is exposed to the pressure within the upper volume, while the surface which is radially inside the thrust seal 20 is exposed to the pressure within the lower volume. The ratio of the area enclosed by thrust seal 20 to the area radially external thereto determines the axial thrust applied to orbiting scroll plate 21** as will be explained hereinbelow.

Immediately below the orbiting scroll plate 21 is a crank 22, affixed to the upper end of a drive shaft 23. Crank 22 is eccentrically offset from the longitudinal axis of drive shaft 23, and is caused to rotate by operation of an electric motor comprising rotor 24 and stator 25. A lower frame member 26 centers the motor and supports it within lower hermetic shell 12. The lower end of drive shaft 23 extends into a journal bearing 27 provided in lower frame 26. The upper portion of the drive shaft, and specifically crank 22, is supported and centered during its rotation by roller bearing 28, contained within supporting frame member 16. A drive stub bearing 29 is eccentrically disposed within crank 22 (relative to the longitudinal axis of drive shaft 23). Bearing 29 rotatingly connects the crank to a drive stub 35 provided on the lower portion of the orbiting scroll plate 21.

Rotation of rotor 24 and drive shaft 23 causes the axis of drive stub 35 to describe a circular motion about the longitudinal axis of drive shaft 23. This rotational motion is translated into an orbital motion as drive stub 35 pivots within bearing 29 in crank 22. The angular relationship between the orbiting scroll plate 21 and the stationary scroll plate 18 is maintained by an Oldham coupling of conventional design, comprising sliding blocks 51, coupling ring 52, and slots 53 disposed in orbiting scroll plate 21. Only two sliding blocks 51 are shown in the drawing figures, each attached to the coupling ring 52; however, it will be understood by those skilled in the art, that two additional sliding blocks are provided, disposed along a line that is orthogonal to the line between sliding blocks 51. The sliding blocks that are not shown are also attached to the connecting ring 52, the side opposite from that on which blocks 51 are attached, and are disposed to slide within slots (not shown) formed within supporting frame member 16.

An involute wrap element 30 is attached to the orbiting scroll plate 21, and extends toward an opposite surface on the stationary scroll plate 18. A similar involute wrap element 31 is attached to the stationary plate 18 and extends toward the facing surface of the orbiting scroll plate 21. The contacting flank surfaces of wrap elements 30 and 31 define pockets of fluid **33*a*, 33*b*, and 33*c*, as shown in FIG. 2. The relative orbital motion of scroll plates 18 and 21 causes the pockets of fluid 33 to move about the axis of the wrap elements 30 and 31, generally toward the center of the involutes. As these fluid pockets 33** move, they become smaller in volume, thereby compressing the fluid trapped within the pockets to a higher pressure.

Fluid to be compressed by compressor 10 enters hermetic shell 11/12 through suction port 34. Suction fluid surrounds the stationary scroll plate and is in communication with the area adjacent the radially outer ends of involute wrap elements 30 and 31 through a plurality of suction passages 35 disposed within a thrust ring 43. Suction fluid is trapped in pockets 33 formed as flank surfaces of involute wrap elements 30 and 31 come into contact. As the compressed fluid reaches the approximate center of the wraps, in pocket **33*c*, it flows through a discharge passage 35 which extends through the center of the drive stub 33. Discharge passage 36 connects the pocket 33*c* in fluid communication with a discharge chamber 37 formed in crank 22. An opening 38 through the perimeter of crank 22 provides fluid communication with the lower volume enclosed within hermetic shell 12**.

It will thus be apparent, that the upper portion of the volume enclosed by hermetic shell 11 is at suction pressure, while the lower volume enclosed by shell 12 is at discharge pressure. These pressures act upon the lower surface of the orbiting scroll plate 21 over an area determined by the radius of thrust seal 20. The larger the radius of thrust seal 20, the greater is the net axial force on orbiting scroll plate 21 tending to force it toward the stationary scroll plate 18. The axial thrust required to provide adequate sealing of the tips of involute wrap elements 30 and 31 against the opposite scroll plates 18 and 21 is easily determined by proper selection of the radius for thrust seal 20, since the suction and discharge pressures, acting on the two areas of scroll plate 21 defined by seal 20 are design parameters.

There is a substantial advantage in providing a discharge path for compressed fluid through drive stub 35 and crank 22, rather than through a port in the stationary scroll plate. By discharging the compressed fluid through passage 36, heat transfer between the suction fluid in the upper volume enclosed by hermetic shell 11 and the hot compressed discharge fluid is minimized. If the more conventional approach of discharging the compressed fluid through the stationary scroll plate 18 were followed, a tube would normally be provided from a port in the stationary plate to a port through the hermetic shell. However, the tube would allow heat transfer between the hot compressed fluid discharged from the compressor and the suction fluid. The subject invention avoids this problem.

The path of the compressed fluid after it is discharged from the orbiting scroll plate is represented in FIG. 3 by the unshaded arrows. After exiting the opening 38, the compressed fluid flows through an annulus between the rotor 24 and stator 25, thereby cooling the motor. The compressed fluid then passes through cutouts 40 which are disposed in the lower supporting framework 26, and into a chamber 41. A discharge port 42 in fluid communication with chamber 41 conveys the compressed fluid outside compressor 10.

The lower portion of hermetic shell 12 includes an oil reservoir 45. Lubricant from the reservoir 45 is supplied through a delivery tube 46 connected via threaded fittings 48 to supporting framework 14; it feeds through passage 48, and thence to a passage 49 in stationary scroll 18. Oil in reservoir 45 is exposed to discharge pressure, whereas the opposite ends of passage 49 is at suction pressure. This differential pressure forces oil to flow up delivery tube 46. The internal bore of delivery tube 46 is relatively small, so that it restricts the flow of oil to a desired rate of flow. Oil forced out of passage 49 is distributed onto the sliding surface of a thrust bearing 50 that is disposed between thrust ring 43 and the upper surface of the orbiting scroll plate 21. The relative motion of the orbiting scroll plate 21 against thrust bearing 50 causes oil to be distributed around the bearing, while the flow of suction gas through passages 35 tends to carry excess lubricant into the pockets 33 being formed between the flank surfaces of wrap elements 30 and 31. Lubricant mixed with the fluid being compressed is thus carried through the compression cycle and is discharged from pocket **33*c* through discharge passage 36 into discharge chamber 37. Centrifugal force resulting from the rotation of crank 22 acts on the lubricant entering chamber 37 causing it to flow up the chamber walls to drive stub bearing 29. The rotational motion of chamber 37** thus separates the entrained lubricant from the compressed fluid and pumps the lubricant upward. The shaded arrows in FIG. 3 show the lubricant flow path.

Lubricant passes through bearing 29 and is thrown radially outward toward the thrust seal 20, coating the underside of the orbiting scroll plate 21 with an oil film. This oil film improves the sealing effectiveness of thrust seal 20 and reduces friction between the seal and the undersurface of the orbiting scroll plate. The oil then runs downward through roller bearing 28, dripping finally back into the reservoir 45 through annulus 39.

Oil entrained in the suction gas further improves the sealing between the involute wrap elements 30 and 31, on both their flank surfaces and tips, thereby eliminating the need for tip seals. The lubricant film on the sliding surfaces of the involutes also reduces friction, increasing the efficiency of the compressor 10. In addition to the previously described benefits, discharge of compressed refrigerant through the orbiting scroll plate provides an improved means for separating an entrained lubricant from the compressed fluid, as compared to the prior art.

While the present invention has been described with respect to a preferred embodiment, it is to be understood that modifications thereto will become apparent to those skilled in the art, which modifications lie within the scope of the present invention, as defined in the claims which follow.

I claim:

1. A scroll machine for compressing a fluid comprising a. two scroll plates with intermeshed involute wrap elements defining pockets in which fluid is compressed as the plates orbit relative to each other;

b. means for driving one of the scroll plates in orbital motion relative to the other scroll plate, said driving means including a drive shaft rotatably connected to the one driven scroll plate at a point eccentrically disposed relative to the longitudinal axis of the drive shaft;

c. a shell hermetically enclosing the scroll plates and the driving means;

d. means for dividing substantially the entire volume enclosed by the hermetic shell into a first part that is at suction pressure and a second part that is at discharge pressure;

e. a passage through said driven scroll plate, adjacent the axial center of its involute wrap element and in fluid communication with the second volume enclosed by the shell, said passage being operative to discharge substantially all the fluid compressed by the orbital motion of the scroll plates;

f. an oil reservoir disposed in the second part of the volume enclosed by the shell;

g. means for delivering oil from the oil reservoir to the radially outer ends of the involute wrap elements, said oil thereafter being carried with the fluid as it is compressed and discharged through said passage in said driven scroll plate; and h. means disposed adjacent the scroll plate for separating the compressed fluid from the oil and for delivering the oil thus separated to one or more bearing surfaces disposed adjacent the passage.

2. The scroll machine of claim 1 wherein the driving means further include a drive stub on said driven scroll plate and a crank on the drive shaft in which the drive stub is seated within a drive stub bearing, said passage extending through said drive stub and said crank.

3. The scroll machine of claim 2 wherein the crank further includes a cavity formed adjacent the drive stub, eccentrically disposed relative to the drive shaft longitudinal axis, and a lateral port in the wall of the cavity through which compressed fluid may flow into the second part of the volume enclosed by the shell.

4. The scroll machine of claim 3 wherein a substantial portion of the oil is separated from the compressed fluid and is forced through the drive stub bearing and thrown radially outward, due to centrifugal force acting on the oil as it is carried into the cavity.

5. The scroll machine of claim 4 wherein the oil that is thrown radially outward impinges on the orbiting scroll plate, passes through a drive shaft bearing, and returns to the oil reservoir.

6. The scroll machine of claim 4 further including a seal between the means dividing the volume enclosed by the hermetic shell and the orbiting scroll plate and wherein the oil that is thrown radially outward impinges on the seal, thereby improving its sealing effectiveness.

7. A scroll machine for compressing a fluid comprising a. two scroll plates with intermeshed involute wrap elements defining pockets in which fluid is compressed as the plates orbit relative to each other;

b. means for driving one of the scroll plates in orbital motion relative to the other scroll plate, said means including a drive shaft having a crank offset relative to the longitudinal axis of the drive shaft, in engagement with said driven scroll plate;

c. an oil reservoir;

d. a first passage connecting the oil reservoir to the radially outer ends of the involute wrap elements and operative to deliver oil thereto, said oil being carried through the compression cycle with the fluid in the pockets defined by the wrap elements;

e. a second passage extending from a point adjacent the radially inner ends of the involute wrap elements through both the driven scroll plate and the crank and operative to discharge the compressed fluid and oil; and f. means disposed within the second passage and adjacent the scroll plate for separating the compressed fluid from the oil and delivering the oil thus separated to adjacent bearing surfaces.

8. The scroll machine of claim 7 wherein the second passage through the crank and the means for separating the oil include a cavity eccentrically disposed relative to the longitudinal axis of the drive shaft, said cavity having an opening providing fluid communication with a volume surrounding the drive shaft.

9. The scroll machine of claim 8 wherein the drive means include a bearing disposed adjacent to and radially outward of the cavity such that centrifugal force developed as the crank rotates causes oil to flow radially outward from the cavity and through the bearing, leaving the compressed fluid to exit the cavity through the opening, the oil thus being substantially separated from the compressed fluid.

10. The scroll machine of claim 9 further comprising a framework for supporting the scroll plates and a seal disposed between the framework and the driven scroll plate radially outward of the bearing, such that oil passing through the bearing is thrown radially outward due to centrifugal force and impinges on the seal, thereby improving its sealing effectiveness.

11. The scroll machine of claim 10 further comprising a drive shaft bearing disposed below the seal such that oil impinging on the seal thereafter flows downwardly through the drive shaft bearing and back into the oil reservoir.

* * * * *